United States Patent [19]

Credelle

[11] Patent Number: 4,484,103

[45] Date of Patent: Nov. 20, 1984

[54] COLOR SELECTION ELECTRON BEAM GUIDE ASSEMBLY FOR FLAT PANEL DISPLAY DEVICES

[75] Inventor: Thomas L. Credelle, Lawrenceville, N.J.

[73] Assignee: RCA Corporation, New York, N.Y.

[21] Appl. No.: 422,450

[22] Filed: Sep. 23, 1982

[51] Int. Cl.[3] ..... H01J 29/74

[52] U.S. Cl. ..... 313/422; 313/432; 315/366

[58] Field of Search ..... 313/422, 432, 439; 315/366

[56] References Cited

U.S. PATENT DOCUMENTS

| | | | |
|---|---|---|---|
| 2,581,487 | 1/1952 | Jenny . | |
| 2,611,099 | 9/1952 | Jenny . | |
| 2,867,749 | 1/1959 | Charlton | 315/21 |
| 2,921,228 | 1/1960 | Farnsworth | 315/13 |
| 2,927,236 | 3/1960 | Andriulis . | |
| 3,148,304 | 9/1964 | Veith et al. | 315/25 |
| 4,117,368 | 9/1978 | Marlowe et al. | 313/422 |
| 4,131,823 | 12/1978 | Credelle | 313/422 |
| 4,335,332 | 6/1982 | Credelle | 313/422 X |

*Primary Examiner*—Palmer Demeo

*Attorney, Agent, or Firm*—Eugene M. Whitacre; Dennis H. Irlbeck; Lester L. Hallacher

[57] ABSTRACT

An electron beam guide assembly for a flat panel display device includes an acceleration electrode having two portions separated by a longitudinal slit. The display device also includes electrodes on support walls which divide the device into channels. By properly voltage biasing the acceleration electrode portions and the support wall electrodes, an electron beam is simultaneously directed to a particular color producing material and transversely scanned across the channels. A color display, therefore, can be produced using one electron beam per channel.

7 Claims, 6 Drawing Figures

COLOR SELECTION ELECTRON BEAM GUIDE ASSEMBLY FOR FLAT PANEL DISPLAY DEVICES

BACKGROUND OF THE INVENTION

This invention relates generally to flat panel display devices and particularly to a color selection electron beam guide assembly for such devices.

U.S. Pat. No. 4,117,368 to F. J. Marlowe discloses a flat panel display device in which a backplate and a faceplate are spaced in parallel planes. A plurality of vanes extend between the backplate and faceplate to divide the envelope into a plurality of channels and to support the faceplate and backplate against atmospheric pressure after the envelope is evacuated. Arranged in each of the channels is a pair of spaced apart parallel beam guide meshes which extend longitudinally along the channels and transversely across the channels. The beam guide meshes serve as guides along which electron beams are propagated the lengths of the channels. Color displays can be produced by propagating three electron beams, one for each of the primary colors red, green and blue, in each channel.

The inside surface of the faceplate is provided with a phosphor screen which luminesces when struck by electrons. When a color display is to be produced, the screen includes three phosphors each of which emits one of the three colors of light. A plurality of extraction electrodes are arranged along the backplate and are used to eject the electron beams from between the beam guide meshes to direct the electron beams toward the phosphor screen. Deflection electrodes are provided on the sides of the support vanes and are electrically energized to cause the electron beams to transversely scan the channels. Accordingly, each of the channels contributes a portion of the total visual display of the device.

U.S. Pat. No. 4,131,823 to T. L. Credelle, discloses a structure for converging the electron beams at the shadow mask of a flat panel display device of the type described in the Marlowe patent. In the Credelle patent, convergence electrodes are provided on the support walls to cause the three electron beams to converge at the shadow mask.

The inventions described in the above-referenced patents are quite satisfactory for the purposes intended. However, the generating of a color display requires that three electron beams propagate in each of the channels and, accordingly, each channel must include three electron guns and the electron beam propagation structures must be capable of simultaneously propagating three electron beams. Additionally, the electron beams should be converged at a color selection shadow mask and the converged beams must be scanned transversely across the channel. For these reasons, such a display device is quite complex. Accordingly, it would be highly advantageous if a color display could be produced utilizing a single electron beam in each of the propagation channels.

The instant invention fulfills this need by the provision of a color selection electron beam guide assembly wherein a color display is produced utilizing a single electron beam in each channel of the display device.

SUMMARY OF THE INVENTION

An electron beam guide assembly for a flat panel device including a multimaterial display screen for producing a color display when struck by electrons and a color selection electrode includes an improved acceleration mesh for accelerating electrons toward the screen comprising a plurality of electrically separated conductive members arranged longitudinally along the channels. The electron beams pass between the conductive members and deflection electrodes and are simultaneously bent and scanned transversely across the channels to pass through the color selection electrode at the proper angle to strike a selected one of the screen materials to produce color line segments across the display screen.

DETAILED DESCRIPTION OF THE PREFERRED EMBODIMENT

Figure 1:
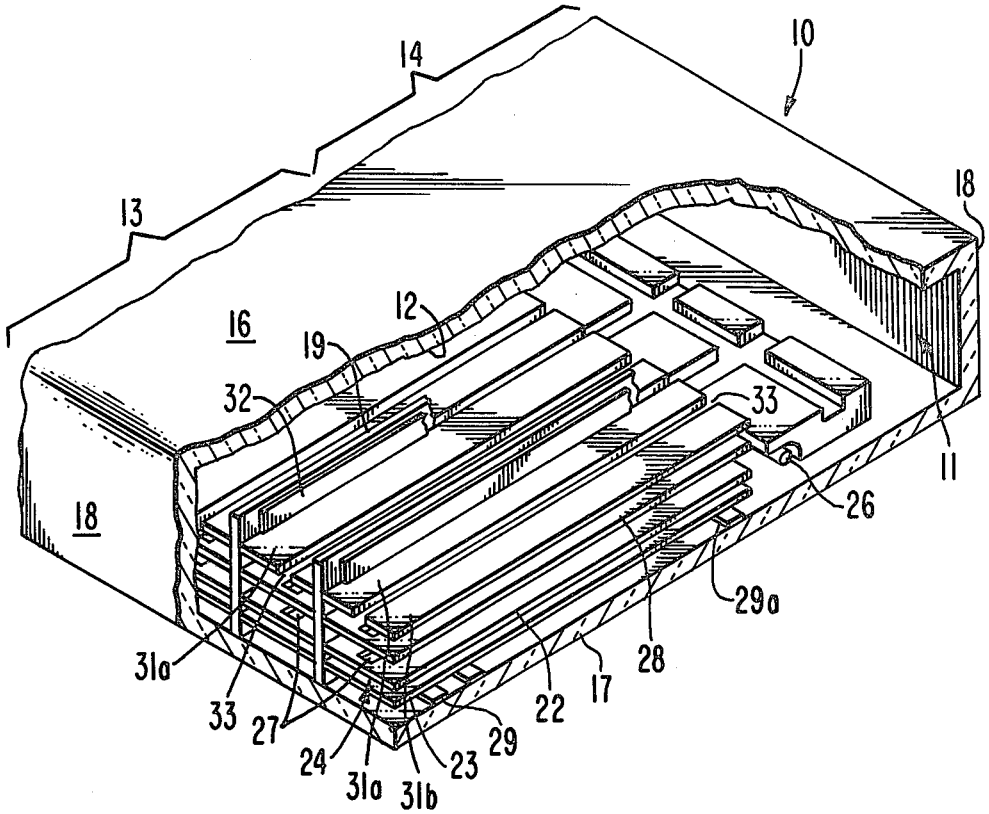
FIG. 1 is a simplified perspective view, partially broken away, showing the major components of a flat panel display device incorporating the invention.

FIG. 1 shows a flat panel display device 10 which incorporates the invention. The display device 10 includes an evacuated envelope 11 having a display section 13 and an electron gun section 14. The envelope 11 includes a frontwall 16 and a backplate 17 held in a spaced parallel relationship by sidewalls 18. A display screen 12 is positioned along the frontwall 16 and gives a visual output when struck by electrons.

A plurality of spaced parallel support vanes 19 are arranged between the frontwall 16 and the backplate 17. The support vanes 19 provide the desired internal support against external atmospheric pressure and divide the envelope 11 into a plurality of channels 21. Each of the channels 21 encloses a pair of spaced parallel beam guide meshes 22 and 23 extending transversely across the channels and longitudinally along the channels from the gun section 14 to the opposite sidewall 18. A cathode 26 is arranged to emit electrons into the spaces 24 between the guide mesh pairs. The guide meshes 22 and 23 include apertures 27 which are arranged in columns longitudinally along the channels 21. A focus mesh 28 is spaced above the upper guide mesh 22 in a parallel relationship therewith. A plurality of extraction electrodes 29 are arranged along the backplate 17 and extend transversely across the channels 21 the full width of the display device 10. The extraction electrodes 29 are arranged directly beneath the apertures 27 in the guide meshes 22 and 23. Appropriate biasing voltages are applied to the focus mesh 28 and the extraction electrodes 29 to cause the electrons emitted from the cathode 26 to propagate along the columns of apertures 27 between the guide meshes 22 and 23 in the spaces 24 for the full length of the channels.

An acceleration electrode comprised of two portions 31*a* and 31*b* is arranged in a spaced parallel relation with the focus mesh 28. The acceleration electrode portions are separated by a longitudinal slit 33 which is parallel to and spaced from the columns of apertures 27 in the focus meshes 28. Electrodes 32 are arranged on both sides of the support vanes 19 so that each vane supports an electrode for two adjacent channels.

In operation, the electron beams propagate in the spaces 24 between the guide meshes 22 and 23 in all of the channels 21 until the production of one line of the visual display requires the beams to be directed toward the screen 12. Extraction of the electron beams from the spaces 24 is effected by applying a negative voltage to one of the extraction electrodes 29. The negative voltage causes the electron beams to pass through the apertures 27 in the guide and focus meshes and the slit 33 between the acceleration electrode portions 31*a* and 31*b*. The extracted electron beams are transversely scanned across the channels between the two support vanes 19 so that each channel contributes a portion of each line of the visual display on the faceplate 16.

Figure 2:
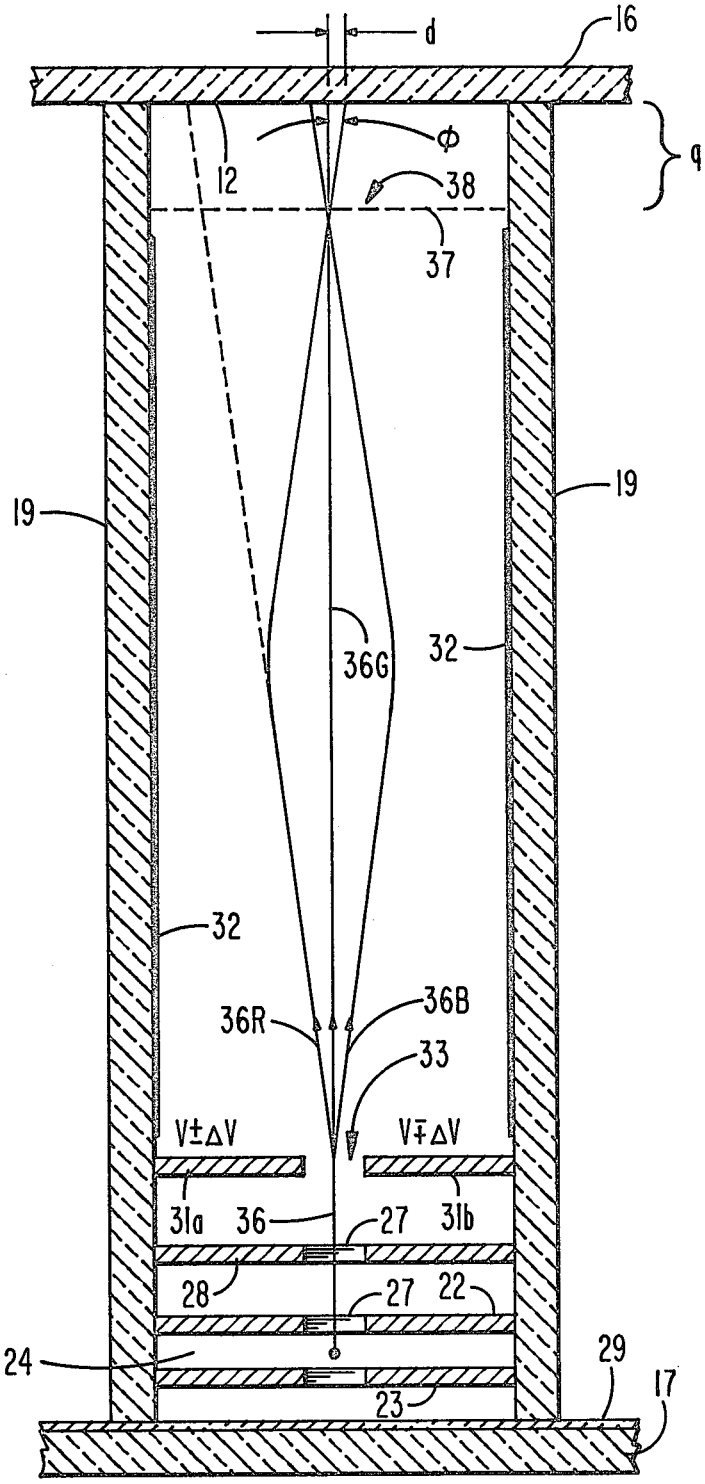
FIG. 2 is a cross-section view of a single channel incorporating a preferred embodiment of the invention.

As shown in FIG. 2, the electron beam is extracted from propagation in the space 24 between the guide meshes 22 and 23 and follows the path 36 through the apertures 27 within the guide meshes 22 and 23 and the focus meshes 28 toward the slit 33 between the acceleration electrode portions 31*a* and 31*b*. The acceleration electrode portions 31*a* and 31*b* typically are biased with a high positive voltage V, which typically is in the order of 10Kv. When both the portions 31*a* and 31*b* are biased at the same voltage V, the electron beam follows the path 36G and travels a substantially straight path toward the screen 12. When the portions 31*a* and 31*b* are differently biased, for example, by adding the incremental voltage $+\Delta V$ to the voltage V on the portion 31*a* and the incremental voltage $-\Delta V$ to the voltage V on the portion 31*b*, the electron beam bends along the path 36R. Similarly, when the portion 31*a* is biased, $V-\Delta V$ and the portion 31*b* is biased $V+\Delta V$ the electron beam bends along the path 36B. The electron beam after being bent along one of the paths 36R or 36B will tend to travel a straight path toward the screen 12 as shown by the phantom line extension of the curved path 36R. However, because a visual display is to be produced on the screen 12, the electron beam must be scanned transversely across the screen. Scanning is accomplished by voltage biasing the electrodes 32 with a varying voltage, examples of which are described hereinafter. The scanning voltage also causes an electron beam traveling along either of the paths 36R or 36B to be bent toward the center of the channel so that the beam travels one of the curved paths shown in FIG. 2.

A color selection electrode 37, such as a shadow mask, is supported at a distance q from the screen 12. As the electron beam is scanned across the shadow mask 37, the beam passes through apertures 38 within the shadow mask and impacts the screen 12. The angle at which the beam passes through the shadow mask 37 determines which color phosphor the beam strikes. The angle is determined by the voltages on the acceleration electrode portions 31*a* and 31*b*. When the portions 31*a* and 31*b* are equally biased, the electron beam follows the straight path 36G, and passes through the center of the shadow mask to impact the screen. The scanning voltage on the electrodes 32 bends the beam to scan a transverse line across the channel, but the same color phosphor is struck during the complete scan. When the electron beam is bent along the path 36R by the combined action of the acceleration voltage and the scanning voltage, the beam passes through the shadow mask at an angle $\phi$ and strikes the screen 12 at a position which is displaced from the unbent impact point by the displacement d. The color select deflection angle $\phi$ thus is $\phi=\tan^{-1}d/q$. When the electron beam follows the path 36B, the displacement d is on the other side of the unbent position and the angle $\phi$ is equal in magnitude and opposite in direction from the angle when the path 36R is followed. Typically, as an example, $\phi$ can be 3.8°. Thus, a color display can be produced by positioning the phosphors on the screen 12 such that the red light emitting phosphor is impacted when the electron beam follows the path 36R and the green and blue colors are produced when the beam follows the paths 36G and 36B respectively. The spacing of the phosphor stripes is selected to be equal to the distance d.

The production of a color display requires the electron beam to sequentially strike the three different color producing phosphors. Thus, the beam is first bent along the path 36R to impact the red light emitting phosphor. After the electron beam has been scanned transversely across the full channel width, the voltages on the acceleration mesh portions 31*a* and 31*b* are made equal and the electron beam follows the path 36G to strike the green light emitting phosphor to produce the green lines. The voltages on the acceleration mesh portions 31*a* and 31*b* are then changed to cause the electron beam to follow the path 36B and produce the blue lines. Thus, all of the channels 21 are simultaneously biased to produce the same color of light and are simultaneously transversely scanned so that each of the channels contributes a portion of each full line of the display.

Figure 4A:
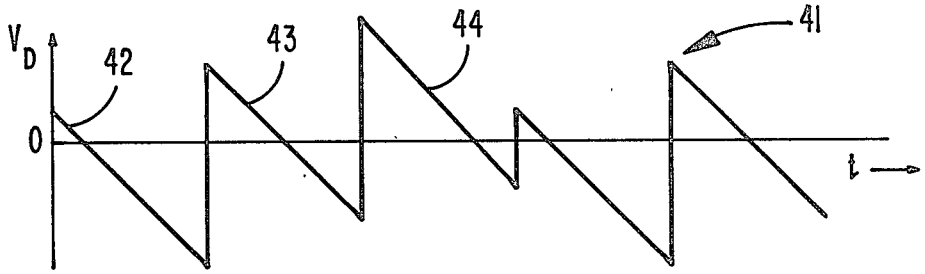
FIG. 4*a* is a voltage waveform which can be used to transversely scan the electron beams across the channels of the display device.
Figure 4B:
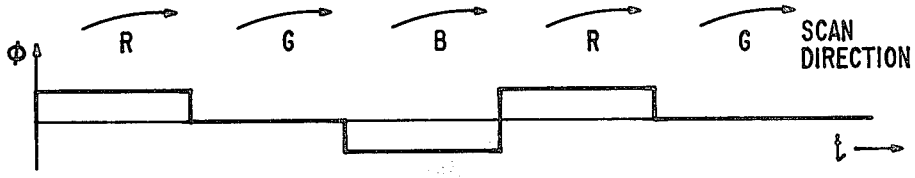
FIG. 4*b* shows the color selection angle of FIG. 4*a*.

FIG. 4*a* shows a sawtooth voltage waveform 41 which can be used to transversely scan the electron beams across the channels. The tooth 42 of the waveform 41 is used to scan the electron beam when the red path 36R is followed by the beams. The color selection angle $\phi$ shown in FIG. 4*b* is constant and, for example, can be +3.8°. When the beam follows the path 36R, one side of the channel is approached and, accordingly, the maximum positive magnitude of the tooth 42 is less than the maximum negative magnitude. The tooth 43 of the sawtooth waveform 41 is used to scan the electron beams when the green path 36G is followed. In this instance, the color selection angle $\phi$ is 0°. The electron beam is normally centered in the channel and, accordingly, the positive and negative magnitudes are equal, and the tooth 43 passes through 0 voltage half-way through the scan interval. When the electron beam follows the blue path 36B, the tooth 44 is used as the deflection voltage. The electron beam then initially travels toward the right-side of the channel, and the maximum positive magnitude is greater than the maximum negative magnitude. When the deflection waveform of FIG. 4*a* is used, the electron beam is scanned from left to right for all three colors.

Figure 5:
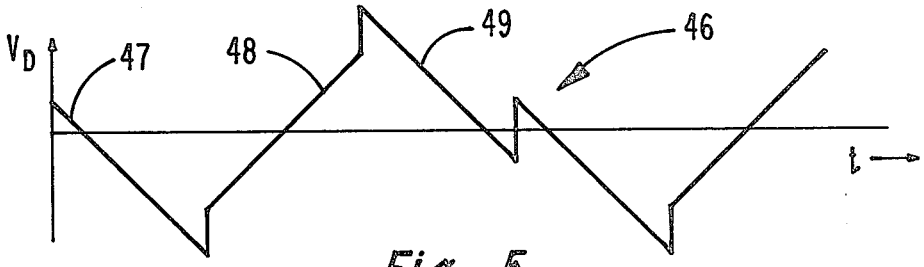
FIG. 5 is another voltage waveform for scanning the electron beams transversely across the channels.

FIG. 5 shows a scanning waveform 46 in which the teeth 47, 48 and 49 are used as the scanning voltages for the electron beam paths 36R, 36G and 36B, respectively. The primary difference between the waveforms of FIG. 4*a* and FIG. 5 is the reversal of the slope of the teeth 43 and 48. Thus, when the green color is being produced, the electron beam is scanned from right to left for the orientation shown in FIG. 2. The reversal of the scanning direction results in a substantial saving of the power consumed in scanning the beams across the channels. Irrespective of whether the waveform of FIG. 4*a* or FIG. 5 is used, the technique of scanning adjacent channels in opposite directions described in U.S. Pat. No. 4,117,368 can be used.

Figure 3:
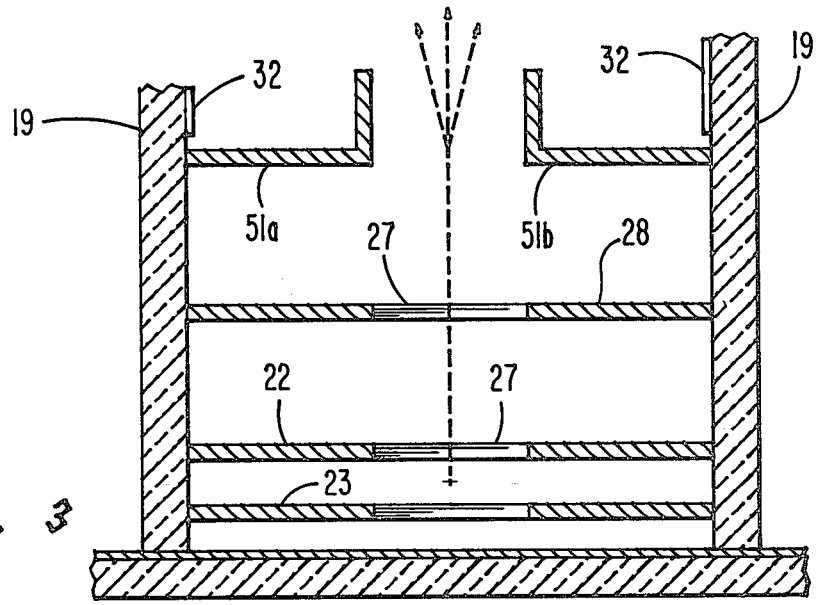
FIG. 3 is a cross-section view of a single channel showing another preferred embodiment of the invention.

FIG. 3 is a preferred embodiment in which the acceleration electrode includes two portions 51*a* and 51*b* which are shaped at 90° and extend upwardly toward the screen 12. In the embodiment of FIG. 2, the color select voltage ΔV typically is approximately 1Kv when the grid voltage V is 10Kv. The color select voltage ΔV can be decreased to approximately 500 volts, for example, when the shaped acceleration grid portions 51*a* and 51*b* are used.

The acceleration electrode portions 31*a* and 31*b* are described as the color select electrodes, and the electrodes 32 are described as the scanning electrodes. The roles of these electrodes can be reversed if desired. The use of the acceleration electrodes portions 31*a* and 31*b* separated by the slit 33 permits the generation of a color display using a single electron beam. Accordingly, each channel includes one electron gun, instead of three as required by the prior art devices. Additionally, the guide meshes 22 and 23 and the focus mesh 27 include only one longitudinal column of apertures and thus are less complex and simpler to fabricate. Other advantages from the longitudinal slit 33 in lieu of a longitudinal column of apertures are realized because the absence of cross ribs between the apertures eliminates critical longitudinal location of the acceleration electrode and lens aberrations which the cross ribs could introduce.

What is claimed is:

1. An electron beam guide assembly for a flat panel display device having a frontwall supporting a multimaterial display screen for emitting color light when struck by electrons, a color selection electrode, a backplate, a plurality of electron beam propagation channels for propagating electron beams parallel to said screen, extraction means for directing said beams toward toward said screen, and deflection means for deflecting said beams transversely of said channels, said beam guide assembly including an improved acceleration mesh for accelerating electrons toward said screen comprising:

a plurality of electrically separated conductive members arranged longitudinally along said channels, said beams passing between said members whereby said deflection means and said conductive members simultaneously bend said beams to pass through said color selection electrode to strike a selected one of said screen materials and scan said beams transversely across said channels to produce line segments across said display screen.

2. The beam guide assembly of claim 1 wherein said conductive members are individual members arranged on opposite sides of the longitudinal center of said channels.

3. The beam guide assembly of claim 2 wherein said members are equally spaced along said center.

4. The beam guide assembly of claim 3 wherein said members have an angular cross-section.

5. The beam guide assembly of claim 4 wherein said angular cross-section is a 90° angle and one side points toward said screen.

6. The beam guide assembly of claim 1 or 4 wherein said conductive members bend said beams and said deflection means scan said beams.

7. The beam guide assembly of claim 1 or 4 wherein said conductive members scan said beams and said deflection means bend said beams.

* * * * *

UNITED STATES PATENT AND TRADEMARK OFFICE

CERTIFICATE OF CORRECTION

PATENT NO. : 4,484,103

DATED : November 20, 1984

INVENTOR(S) : Thomas Lloyd Credelle

It is certified that error appears in the above-identified patent and that said Letters Patent is hereby corrected as shown below:

Column 2, line 27, after "angle" insert -- for the waveform --

Signed and Sealed this

*Twenty-eighth* Day of *May 1985*

[SEAL]

*Attest:*

DONALD J. QUIGG

*Attesting Officer* *Acting Commissioner of Patents and Trademarks*